United States Patent [19]

Englehart

[11] Patent Number: 5,075,916

[45] Date of Patent: Dec. 31, 1991

[54] TOOL FOR FORMING SMOOTH CAULKED JOINTS

[76] Inventor: Ross L. Englehart, 5200 Kalmia Dr., Dayton, Md. 21036

[21] Appl. No.: 622,103

[22] Filed: Nov. 27, 1990

[51] Int. Cl.[5] ..... E04F 21/28

[52] U.S. Cl. ..... 15/104 S; 81/488; 7/105; 425/458; 15/105

[58] Field of Search ..... 7/105; 81/488; 15/235.3-235.8, 236.01, 236.02, 104 S, 105.5; 425/458; D8/45

[56] References Cited

U.S. PATENT DOCUMENTS

| | | | |
|---|---|---|---|
| 1,000,333 | 8/1911 | Hall | 15/104 S |
| 1,851,497 | 3/1932 | Darling | 15/235.3 |
| 3,611,469 | 10/1971 | Belli | 15/104 S |
| 3,744,079 | 7/1973 | Krause | 7/105 |
| 3,821,828 | 7/1974 | Pearson | 7/105 |

FOREIGN PATENT DOCUMENTS

| | | | |
|---|---|---|---|
| 956549 | 10/1974 | Canada | 15/235.7 |

*Primary Examiner*—Roscoe V. Parker
*Attorney, Agent, or Firm*—Donald A. Kettlestrings

[57] ABSTRACT

A tool for enabling the formation of smooth caulked joints between perpendicular surfaces includes a flat rectangular element defining four straight exterior edges and defining four corners of predetermined configuration whereby smooth caulked joints can be quickly and easily formed by moving the tool along the length of the caulked joint while maintaining the tool in contact with the perpendicular surfaces.

9 Claims, 2 Drawing Sheets

TOOL FOR FORMING SMOOTH CAULKED JOINTS

This invention relates to a tool and more particularly to a tool for enabling the formation of smooth caulked joints between substantially perpendicular surfaces.

Conventional methods used in caulking joints often result in an uneven and unattractive appearance. Typically, caulking is applied to a joint by a conventional caulking gun, and the caulking is then smoothed out with fingers. The result is often an uneven appearance. Using fingers to smooth the caulking also causes the fingers to be covered with the caulking, and skin irritation can be a problem for some people.

It is, therefore, an object of the present invention to provide a tool for enabling the formation of smooth caulked joints between substantially perpendicular surfaces.

Another object is to provide such a tool which quickly and easily forms smooth caulked joints.

A further object of the invention is the provision of such a tool which enables the formation of smooth caulked joints having various types of surface configurations.

Still another object is to provide such a tool which is easy to use by right-handed and left-handed persons and which is inexpensive to manufacture.

A still further object is to provide such a tool which enables freshly applied caulking to be quickly and easily removed from a joint if a mistake has been made in applying the caulking to the joint.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a tool which comprises a substantially flat rectangular element defining first, second, third and fourth substantially straight exterior edges. The element further defines a first exterior substantially right-angle corner, a second exterior rounded corner, a third corner defining a fifth straight edge of first predetermined length intersecting and defining an angle of substantially one hundred thirty-five degrees with respect to predetermined of said exterior edges, and a fourth corner defining a sixth straight edge of second predetermined length greater than the first predetermined length intersecting and defining an angle of substantially one hundred thirty-five degrees with respect to predetermined of said exterior edges.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

Figure 1:
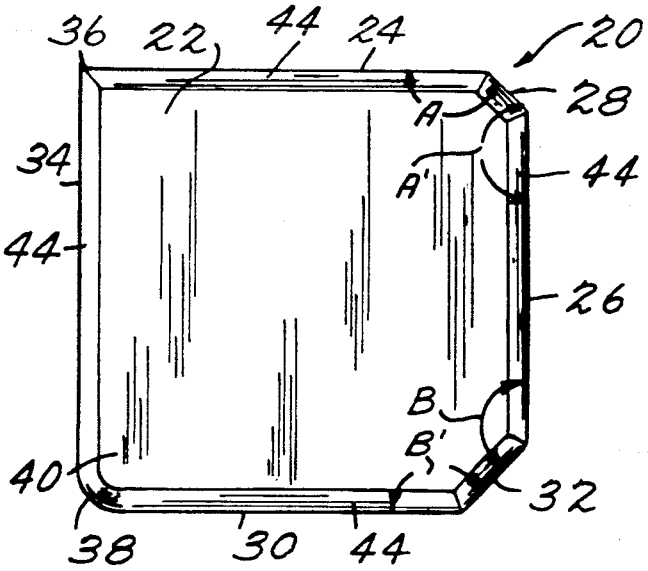
FIG. 1 is a front elevation view of the tool.
Figure 2:
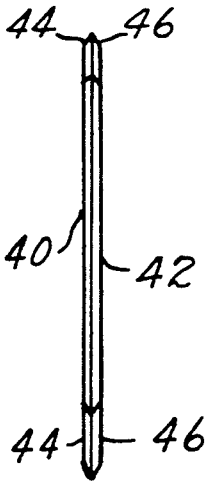
FIG. 2 is a side elevation view of the tool.

With reference now to the drawings, wherein like reference characters designate like or corresponding parts throughout the several views, there is shown tool 20 in accordance with this invention. Tool 20 is comprised of substantially flat rectangular element 22, and element 22 defines first and second substantially straight edges 24, 26 in substantially perpendicular relationship with each other. Element 22 further defines a third edge 28 of first predetermined length extending between edges 24 and 26, and edge 28 preferably defines an angle A of substantially one hundred thirty-five degrees with edge 24. Edge 28 also preferably defines an angle A' of substantially one hundred thirty-five degrees with edge 26. It should be understood that it is within the scope of this invention to modify angles A, A' to greater or lesser values.

In accordance with the invention, tool 20 and element 22 further define a fourth edge 30 in substantially perpendicular relationship with edge 26. A fifth edge 32 of second predetermined length greater than the length of edge 28 extends between edges 26 and 30. Edge 32 preferably defines an angle B of substantially one hundred thirty-five degrees with edge 26, and edge 32 preferably defines an angle B' of substantially one hundred thirty-five degrees with edge 30. It should also be understood that it is within the scope of this invention to modify angles B, B' to greater or lesser values.

Tool 20 and element 22 further define a sixth edge 34 in intersecting and substantially perpendicular relationship with edge 24 to form a substantially right-angle corner 36 between edges 24 and 34.

Edge 34 also is in substantially perpendicular relationship with edge 30, and a seventh rounded edge or corner 38 extends between edges 30 and 34. Rounded edge 38 preferably defines a convex exterior edge surface, as illustrated in the drawings, but edge 38 could define a concave exterior edge surface.

Tool 20 and element 22 further define first and second opposed and substantially parallel flat surfaces 40, 42 located within the perimeter formed by the exterior edges of element 22. Tool 20 and element 22 also further define a first beveled surface 44 extending between each of the exterior edges of element 22 and flat surface 40. Similarly, a second beveled surface 46 extends between each of the exterior edges of element 22 and flat surface 42.

Figure 3:
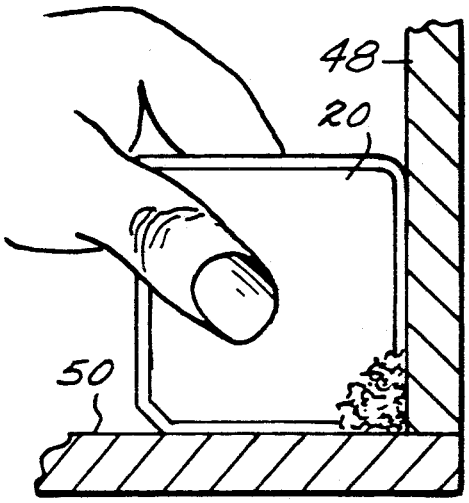
FIG. 3 shows the tool in use as the tool is drawn toward the operator excess caulk on the side of the tool facing the operator.
Figure 4:
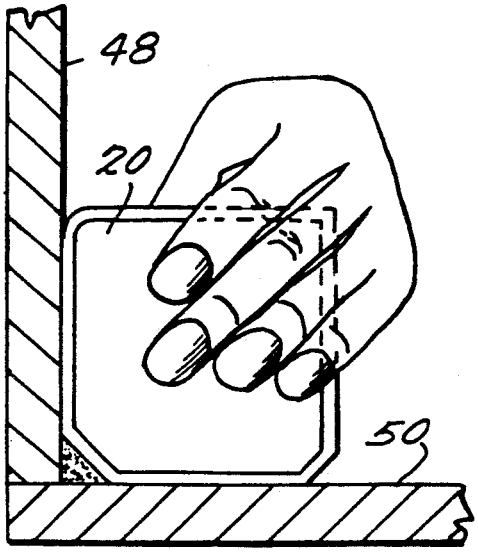
FIG. 4 shows the tool in use and viewing the side of the tool positioned facing away from the operator.
Figure 5:
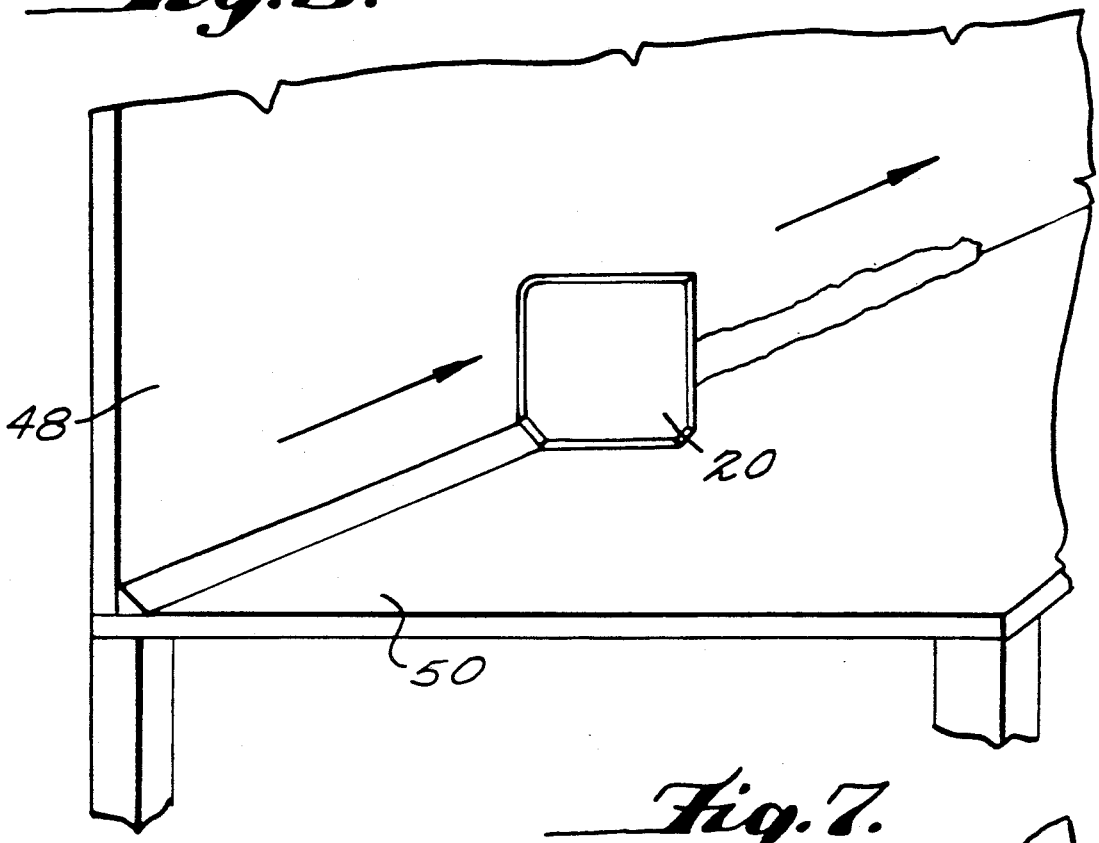
FIG. 5 is another view of the tool in use, but not showing the operator.

In operation, caulk is applied in a conventional manner by a conventional caulking gun to the joint between substantially perpendicular surfaces 48, 50, as illustrated in FIGS. 3–5. While the caulk is still fresh and moist, tool 20 is held and positioned in a substantially perpendicular relationship with respect to surfaces 48, 50, as shown in FIGS. 3–5. Tool 20 is then pulled or pushed by the operator while maintaining the tool in sliding contact with surfaces 48, 50. In this manner, tool 20 is moved along the length of the caulked joint, and any excess caulk is gathered and collected on the leading surface of the tool, as shown in FIG. 3. Depending upon which corner of tool 20 is positioned against the caulk, a perfect bead of caulk will be created by tool 20 as it passes along the length of the joint. Tool 20 can then be quickly and easily cleaned of the excess caulk, and the tool is ready for reuse, or the tool can be disposed of after use.

Figure 6:
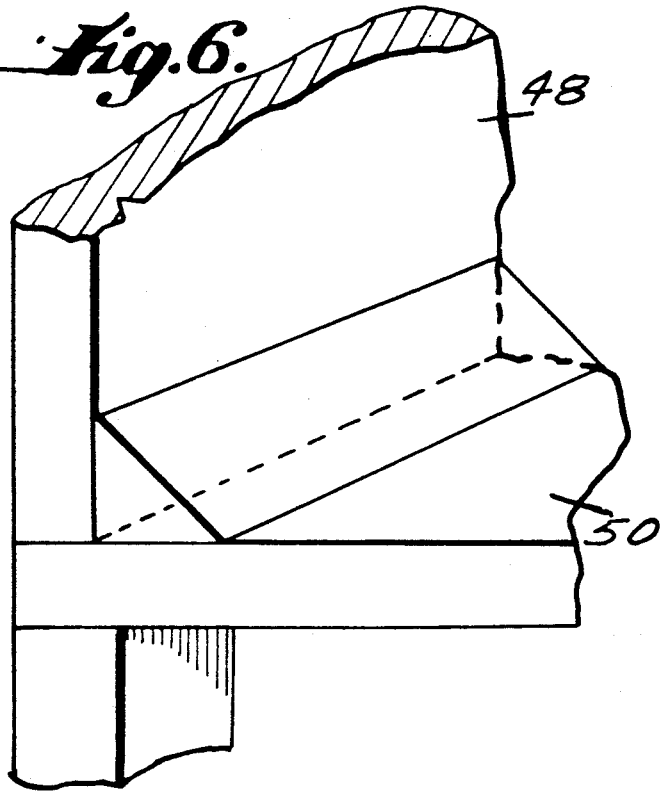
FIG. 6 is a view showing an example of a caulked joint that has been smoothed by the tool to form a forty-five degree bead of caulk.

If, for example, edge 28 of the tool is positioned in contact with the caulk, a perfect forty-five degree bead of caulk will be formed by tool 20 as it is moved along the length of the caulked joint. A larger forty-five degree bead of caulk can be formed by positioning and moving the tool with edge 32 in contact with the caulk. Edge 32 of the tool can also be used to cover over a previously applied smaller bead of caulk. FIG. 6 shows an example of a bead of caulk formed by edge 28 or by edge 32.

Figure 7:
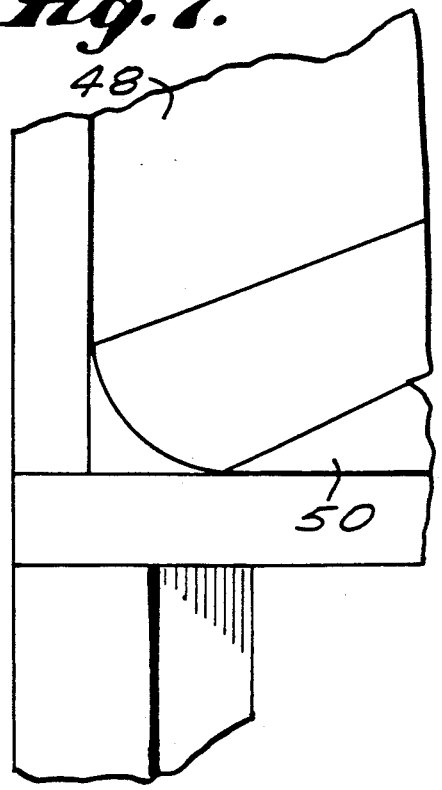
FIG. 7 is a view showing an example of a caulked joint that has been smoothed by the tool to form a concave caulk bead.

If a concave caulk bead, as shown in FIG. 7, is desired, rounded edge 38 of the tool can be positioned in contact with the newly applied caulk. Movement of tool 20 along the caulked joint will then form a caulking bead as shown in FIG. 7. If a convex caulk bead is desired, a tool 20 can be provided wherein rounded corner 38 is concave instead of convex. This embodiment is not illustrated.

If a mistake is made in applying caulk to the joint, corner 36 of the tool can be used to clean out the freshly applied caulk.

Tool 20 is preferably made of a slightly flexible latex or rubber material to allow it to slightly flex and bend. This will enable the tool to perform well if surfaces 48, 50 are slightly uneven. Beveled surfaces 44, 46 are an important feature of this invention because they allow for increased flexibility of the tool adjacent to the edge surfaces as the tool is moved along surfaces 48, 50. Beveled surfaces 44, 46 also enable the edges of the tool to be narrower, and the narrow edges of tool 20 enhance the formation of a smooth caulking bead as the tool is drawn along the length of the moist caulking. The beveled surfaces of the tool also enhance a clean gathering of caulk at the leading side of the tool as the tool is moved along the caulked joint. Either surface 40 or 42 can be used as the leading edge of the tool to allow the tool to be used by right-handed and left-handed persons.

The invention in its broader aspects is not limited to the specific details shown and described, and departures may be made from such details without departing from the principles of the invention and without sacrificing its chief advantages.

What is claimed is:

1. A tool for enabling the formation of a smooth caulking joint between substantially perpendicular surfaces, said tool defining first and second edges in substantially perpendicular relationship with each other and a third edge of first predetermined length extending between said first and second edges, said third edge defining an angle of substantially one hundred thirty-five degrees with each of said first and second edges, and said tool further defining a fourth edge in substantially perpendicular relationship with said second edge and a fifth edge of second predetermined length greater than said first predetermined length extending between said second and fourth edges, said fifth edge defining an angle of substantially one hundred thirty-five degrees with each of said second and said fourth edges.

2. A tool as in claim 1 further defining a sixth edge in intersecting and substantially perpendicular relationship with said first edge to form a substantially right-angle corner between said first edge and said sixth edge.

3. A tool as in claim 2 wherein said sixth edge is in substantially perpendicular relationship with said fourth edge and wherein said tool further defines a seventh rounded edge extending between said fourth and sixth edges.

4. A tool as in claim 3 wherein said rounded edge defines a convex exterior edge surface.

5. A tool as in claim 4 wherein said tool further defines first and second opposed and substantially parallel flat surfaces located within a perimeter formed by said edges.

6. A tool as in claim 5 wherein said tool further defines a first beveled surface extending between each of said edges and said first flat surface and a second beveled surface extending between each of said edges and said second flat surface.

7. A tool for enabling the formation of a smooth caulking joint between substantially perpendicular surfaces, said tool comprising a substantially flat rectangular element defining first, second, third and fourth exterior edges, and said element further defining a first exterior substantially right-angle corner, a second exterior rounded corner, a third corner defining a fifth straight edge of first predetermined length intersecting and defining an angle of substantially one hundred thirty-five degrees with respect to predetermined of said exterior edges, and a fourth corner defining a sixth straight edge of second predetermined length greater than said first predetermined length intersecting and defining an angle of substantially one hundred thirty-five degrees with respect to predetermined of said exterior edges.

8. A tool as in claim 7 wherein said element further defines first and second beveled surfaces adjacent to and contiguous with said exterior edges, said straight edges and said corners.

9. A tool as in claim 8 wherein said element further defines first and second opposed and substantially parallel flat surfaces, said first flat surface in intersecting relationship with said first beveled surface and said second flat surface in intersecting relationship with said second beveled surface.

* * * * *